US009928799B2

(12) United States Patent
Lee et al.

(10) Patent No.: US 9,928,799 B2
(45) Date of Patent: Mar. 27, 2018

(54) SOURCE DRIVER AND OPERATING METHOD THEREOF FOR CONTROLLING OUTPUT TIMING OF A DATA SIGNAL

(71) Applicant: SAMSUNG ELECTRONICS CO., LTD., Suwon-si, Gyeonggi-Do (KR)

(72) Inventors: HaJun Lee, Seoul (KR); Jin-Han Kim, Suwon-si (KR); Junho Song, Seoul (KR); SeongJong Yoo, Seongnam-si (KR); Yeonwoo Jung, Seoul (KR); Yong-Hun Kim, Seoul (KR); Keemoon Chun, Seongnam-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 43 days.

(21) Appl. No.: 14/851,265

(22) Filed: Sep. 11, 2015

(65) Prior Publication Data

US 2016/0093237 A1 Mar. 31, 2016

(30) Foreign Application Priority Data

Sep. 29, 2014 (KR) ..... 10-2014-0130188

(51) Int. Cl.
*G09G 3/36* (2006.01)

(52) U.S. Cl.
CPC ... *G09G 3/3688* (2013.01); *G09G 2310/0286* (2013.01); *G09G 2310/0291* (2013.01); *G09G 2310/0297* (2013.01); *G09G 2310/08* (2013.01)

(58) Field of Classification Search
CPC .. G09G 3/3685; G09G 3/3688; G09G 3/3283; G09G 3/3291; G09G 3/3275; G09G 2310/0297; G09G 2310/08; G09G 2310/0291; G09G 2310/0286
See application file for complete search history.

(56) References Cited

U.S. PATENT DOCUMENTS 6,909,418 B2 6/2005 Arai
7,170,505 B2 * 1/2007 Akahori ..... G09G 5/006 327/276
7,477,225 B2 1/2009 Nakamura
7,965,271 B2 6/2011 Fan et al.
(Continued)

FOREIGN PATENT DOCUMENTS

JP 2007-057637 3/2007
KR 20090022052 A * 3/2009
KR 1020110119375 11/2011

*Primary Examiner* — Darlene M Ritchie
(74) *Attorney, Agent, or Firm* — F. Chau & Associates, LLC

(57) ABSTRACT

A source driver circuit is provided which includes a plurality of digital multi-spread (hereinafter referred to as "DMS") blocks configured to generate DMS signals for controlling an output timing of a data signal to be transmitted to a display panel from a plurality of clocks which are delayed as much as a reference period one another. Each DMS block includes a plurality of sub blocks. Each of the sub blocks includes an enable signal generator and a delay unit. The enable signal generator generates an enable signal for outputting target DMS signals of the DMS signals using clocks selected from the plurality of clocks. The delay unit delays the DMS signals such that the DMS signals are sequentially delayed by the reference period.

13 Claims, 14 Drawing Sheets

(56) References Cited

U.S. PATENT DOCUMENTS 8,081,151 B2 * 12/2011 Kishimoto ..... G09G 3/20 345/100
8,085,236 B2 12/2011 Ohkawa et al.
8,576,155 B2 11/2013 Osame et al.
8,823,626 B2 9/2014 Minami
8,878,792 B2 * 11/2014 Lim ..... H03L 7/0805 178/18.01
2002/0080107 A1 * 6/2002 Fujimoto ..... G09G 3/3611 345/87
2004/0257321 A1 * 12/2004 Baek ..... G09G 5/18 345/87
2005/0156865 A1 * 7/2005 Suh ..... G09G 3/3685 345/100
2005/0258879 A1 * 11/2005 Marutani ..... H03K 23/64 327/117
2007/0091054 A1 4/2007 Lee
2007/0159440 A1 * 7/2007 Kang ..... G09G 3/2096 345/99
2009/0058788 A1 * 3/2009 Ha ..... G09G 3/3611 345/99
2009/0066676 A1 * 3/2009 Jo ..... G09G 3/3688 345/204
2009/0146940 A1 6/2009 Kang et al.
2010/0277494 A1 * 11/2010 Cho ..... G09G 3/3614 345/589
2011/0279420 A1 11/2011 Sung et al.
2011/0316816 A1 * 12/2011 Okuma ..... G09G 3/3688 345/204
2013/0187843 A1 * 7/2013 Iwamoto ..... G09G 3/3611 345/100
2014/0043065 A1 * 2/2014 Hung ..... H03K 3/01 327/108
2016/0063957 A1 * 3/2016 Shirasaki ..... G09G 3/20 345/213

* cited by examiner

SOURCE DRIVER AND OPERATING METHOD THEREOF FOR CONTROLLING OUTPUT TIMING OF A DATA SIGNAL

CROSS-REFERENCE TO RELATED APPLICATIONS

This application claims priority under 35 U.S.C. § 119 to Korean Patent Application No. 10-2014-0130188 filed on Sep. 29, 2014, in the Korean Intellectual Property Office, the disclosure of which is incorporated by reference herein.

BACKGROUND

1. Technical Field

Embodiments of the inventive concepts described herein relate to a display device, and more particularly, relate to a source driver to control image data to be output to a display panel.

2. Discussion of Related Art

A display device includes a plurality of pixels that are arranged at intersections of gate lines and source lines. The display device includes a gate driver to drive the gate lines and a source driver to provide image information to a display panel of the display device. The source driver may include a shift register that generates a control signal for controlling the timing of when image information is output to the display panel.

The source driver generates a signal for controlling the timing of when image information is output to the display panel, based on a carry signal. That is, each shift register (e.g., a stage) of a group of shift registers generates a timing control signal using a carry signal from a previous stage.

Various problems occur when the timing control signal is generated using a carry signal. For example, when an operating frequency or a scanning rate of the display device is high and the number of pixels is high, it can be difficult to control the output timing of data precisely due to an excessive delay that arises upon transferring a carry signal between shift registers. In addition, the time taken to charge pixels is reduced and causes a problem where image information is not normally output to the display panel.

SUMMARY

An exemplary embodiment of the inventive concept is directed to provide a source driver circuit which includes a plurality of digital multi-spread (hereinafter referred to as "DMS") blocks (e.g., main circuits) configured to generate DMS signals for controlling an output timing of a data signal to be transmitted to a display panel from a plurality of clocks which are delayed by a reference period from one another, each DMS block including a plurality of sub blocks (e.g., sub circuits). Each of the sub blocks includes an enable signal generator and a delay unit. The enable signal generator generates an enable signal for outputting target DMS signals (e.g., a subset) of the DMS signals using clocks selected from the plurality of clocks. The delay unit delays the target DMS signals such that the target DMS signals are sequentially delayed by the reference period. Each sub block outputs the target DMS signal in response to the enable signal.

The source driver circuit may further include control logic configured to generate the clocks to be transmitted to the DMS blocks, to convert external image information into parallel image information, and to generate a gamma reference voltage used to output the data signal to the display panel.

The source driver circuit may further include a first latch configured to receive the parallel image information from the control logic.

The source driver circuit may further include a second latch configured to receive the parallel image information from the first latch and the DMS signals from the DMS blocks.

The source driver circuit may further include a decoder configured to convert the parallel image information, stored at the second latch, into the data signal depending on the gamma reference voltage, during a period where the DMS signals are activated.

The source driver circuit may further include a display panel.

The control logic may enable the DMS blocks to generate the DMS signals according to one of a left-shift manner, a right-shift manner, or a dual-shift manner.

The enable signal may be generated based on one, having the greatest delay, from among the selected clocks.

The reference period may correspond to a value obtained by dividing a period of the clocks by the number of the clocks.

The enable signal that each sub block generates may be delayed by an integer multiple of the reference period and an enable signal generated from an adjacent sub block.

An exemplary embodiment of the inventive concept is directed to provide a method of operating a display device. The method includes generating a plurality of clocks which are delayed by a reference period from one another from a clock received from an external device; generating an enable signal for outputting target DMS signals (e.g., a subset) of DMS signals, which control an output timing of a data signal to be transmitted to a display panel, using clocks selected from the plurality of clocks; and generating the target DMS signals from the selected clocks using the enable signal; and outputting the data signal to the display panel during a period where the target DMS signals are activated.

The DMS signals may be delayed by the reference period.

The enable signal may be generated using a first one among the selected clocks having the greatest delay.

The enable signal may be delayed by an integer multiple of the reference period and an enable signal generated from a second other one of the selected clocks.

The DMS signals may be generated according to one of a left-shift manner, a right-shift manner, or a dual-shift manner.

An exemplary embodiment of the inventive concept is directed to provide a display device which includes a timing controller, a display panel, a source driver, and a gate driver. The timing controller receives a plurality of clocks which are delayed by a reference period from one another, image information, source control signals, and gate control signals. The display panel includes pixels arranged at intersections of source lines and gate lines. The source driver receives the source control signals and the image information and outputs a data signal corresponding to the image information to the source lines. The gate driver receives the gate control signals and drives the gate lines connected to the pixels. The source drivers includes a plurality of DMS blocks (e.g, main circuits) that generate DMS signals for controlling an output timing of a data signal to be transmitted to a display panel from the clocks, each DMS block including a plurality of sub blocks (e.g., sub circuits). Each of the sub blocks includes an enable signal generator and a delay unit. The enable signal generator generates an enable signal for outputting target DMS signals (e.g., a subset) of the DMS signals using clocks selected from the plurality of clocks. The delay unit delays the corresponding target DMS signals such that the target DMS signals are sequentially delayed by the reference period. Each sub block outputs the target DMS signals in response to the enable signal.

The display device may further include control logic configured to generate the clocks to be transmitted to the DMS blocks, to convert the image information into parallel image information, and to generate a gamma reference voltage used to output the data signal to the display panel.

The display device may further include a first latch configured to receive the parallel image information from the control logic.

The display device may further include a second latch configured to receive the parallel image information from the first latch and the DMS signals from the DMS blocks.

The display device may further include a decoder configured to convert the parallel image information, stored at the second latch, into the data signal depending on the gamma reference voltage, during a period where the DMS signals are activated.

According to an exemplary embodiment of the inventive concept, a source driver circuit is provided including a plurality of main circuits configured to generate signals for controlling an output timing of a data signal to be transmitted to a display panel, wherein the signals are generated from a plurality of clocks which are delayed by a reference period from one another. Each main circuit includes a plurality of sub circuits. Each sub circuit generates an enable signal from a distinct two of the clocks, generates a first one of the signals from performing an AND operation on one of the two clocks and the enable signal, and generates a second one of the signals from performing an AND operation on the other of the two clocks and the enable signal.

BRIEF DESCRIPTION OF THE FIGURES

Exemplary embodiment of the inventive concept will become apparent from the following description with reference to the following figures, wherein like reference numerals refer to like parts throughout the various figures unless otherwise specified, and wherein FIG. 1 a block diagram schematically illustrating a display device according to an exemplary embodiment of the inventive concept.

DETAILED DESCRIPTION

Figure 1:
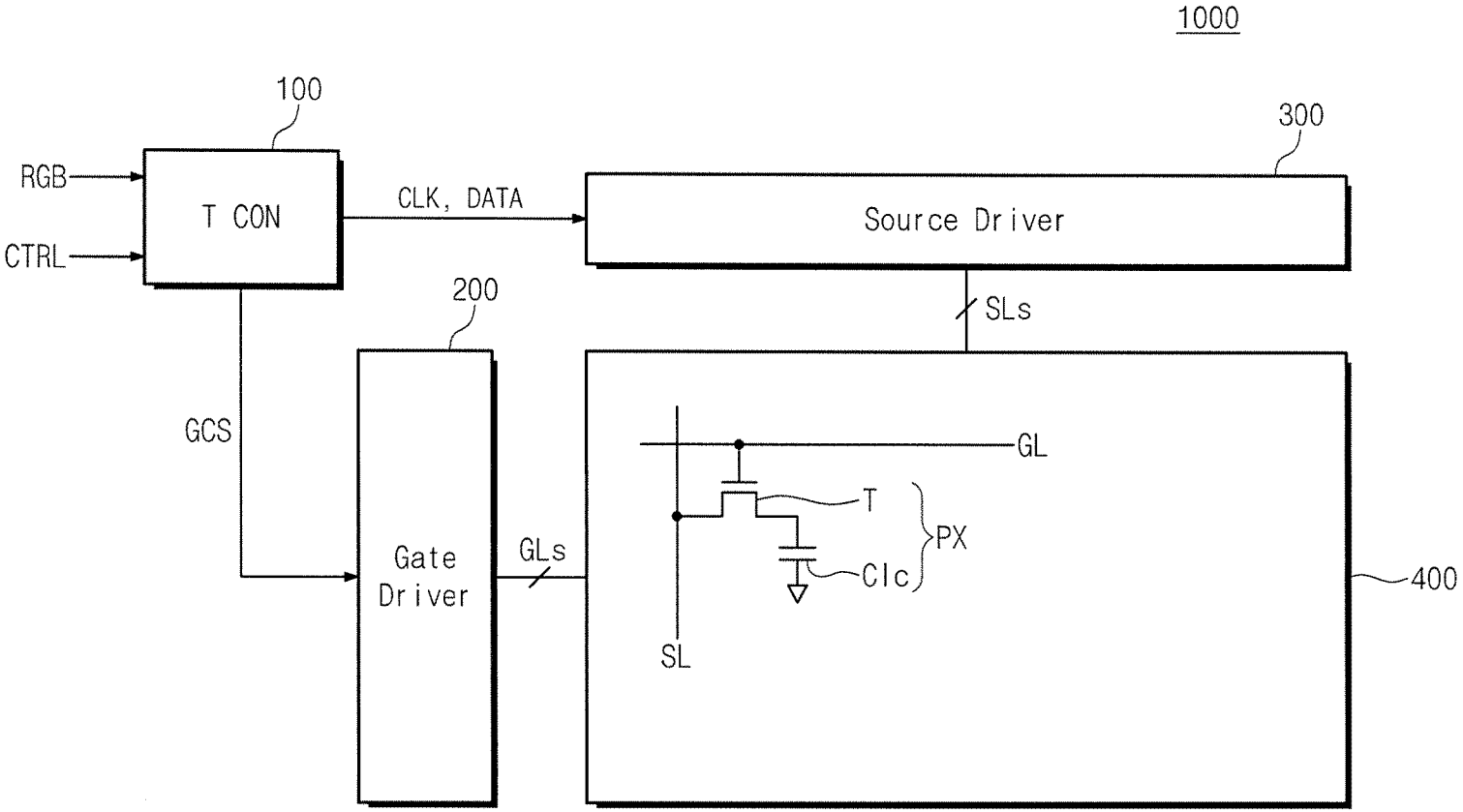

Embodiments will be described in detail with reference to the accompanying drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Unless otherwise noted, like reference numerals denote like elements throughout the attached drawings and written description, and thus descriptions will not be repeated. In the drawings, the sizes and relative sizes of layers and regions may be exaggerated for clarity.

As used herein, the singular forms "a", "an" and "the" are intended to include the plural forms as well, unless the context clearly indicates otherwise. It will be understood that when an element or layer is referred to as being "on", "connected to", "coupled to", or "adjacent to" another element or layer, it can be directly on, connected, coupled, or adjacent to the other element or layer, or intervening elements or layers may be present.

FIG. 1 a block diagram schematically illustrating a display device according to an exemplary embodiment of the inventive concept. Referring to FIG. 1, a display device 1000 contains a timing controller 100, a gate driver 200, a source driver 300, and a display panel 400.

The timing controller 100 receives image information RGB and a control signal CTRL. The image information RGB may include red, green, and blue data for one or more pixels of the display panel 400. The control signal CTRL may include the following: a vertical synchronization signal Vsync, a horizontal synchronization signal Hsync, and a clock CLK. The timing controller 100 converts a format of the image information RGB to a format compatible with the specification of the source driver 300 to generate serialized data DATA. The timing controller 100 transmits the data DATA to the source driver 300. In an exemplary embodiment, the timing controller 100 simultaneously transmits the data DATA and the clock CLK through one channel in the form of an embedded clock. For example, time division multiplexing may be used to transmit both the data DATA and the clock CLK using a single channel. However, the inventive concept is not limited thereto. For example, the data and the clock CLK may be transmitted through separate channels, respectively.

The timing controller 100 generates a gate control signal GCS in response to the control signal CTRL and provides the gate control signal GCS to the gate driver 200. The gate control signal GCS may include the following: a signal indicating a start of a scan, a signal for controlling an output period of a gate on voltage, and a signal for adjusting the duration of the gate on voltage. The gate lines may be sequentially driven in various orders. For example, in a forward scan, the gate lines are sequentially scanned (e.g., a gate on voltage is applied to each gate line) in order from the first gate line through the last gate line and the start of the scan refers to the time when this scan begins.

The gate driver 200 drives gate lines in response to the gate control signal GCS such that data is sequentially output to the display panel.

The source driver 300 provides the display panel 400 with a gray scale voltage corresponding to data through source lines in response to a source control signal. In an exemplary embodiment, the clock CLK is the source control signal. The source driver 300 may generate a signal for controlling timing when the data is output to the display panel 400.

A carry signal is generally used to generate a signal for controlling the timing. However, when an operating frequency or a scanning rate of a display device is high and the number of pixels is high, it can be difficult to generate the timing control signal using the carry signal. In an exemplary embodiment of the inventive concept, the carry signal is not used to generate a timing signal that enables data to be output to the display panel 400. Instead, a timing control signal is generated using a clock CLK that is provided to the source driver 300. Accordingly, a display device may operate stably under a high frequency and a low voltage.

The display panel 400 includes pixels PX that are arranged at intersections of gate lines and source lines. The display panel 400 may be implemented with a liquid crystal display panel (LCD), an electrophoretic display panel, an electrowetting display panel, a plasma display panel (PDP), an organic light-emitting diode (OLED), and so on.

Each of the pixels PX of the display panel 400 includes a thin film transistor T and a liquid crystal capacitor Clc. Each pixel may display red, green, or blue image data.

In each pixel, the thin film transistor T is connected to a source line SL, operates in response to a gate voltage transferred through a gate line GL, and provides a data signal transferred through a source line SL to the liquid crystal capacitor Clc.

The liquid crystal capacitor Clc is connected to the thin film transistor T and includes a liquid crystal layer for adjusting a penetration ratio of light based on a voltage level.

Figure 2:
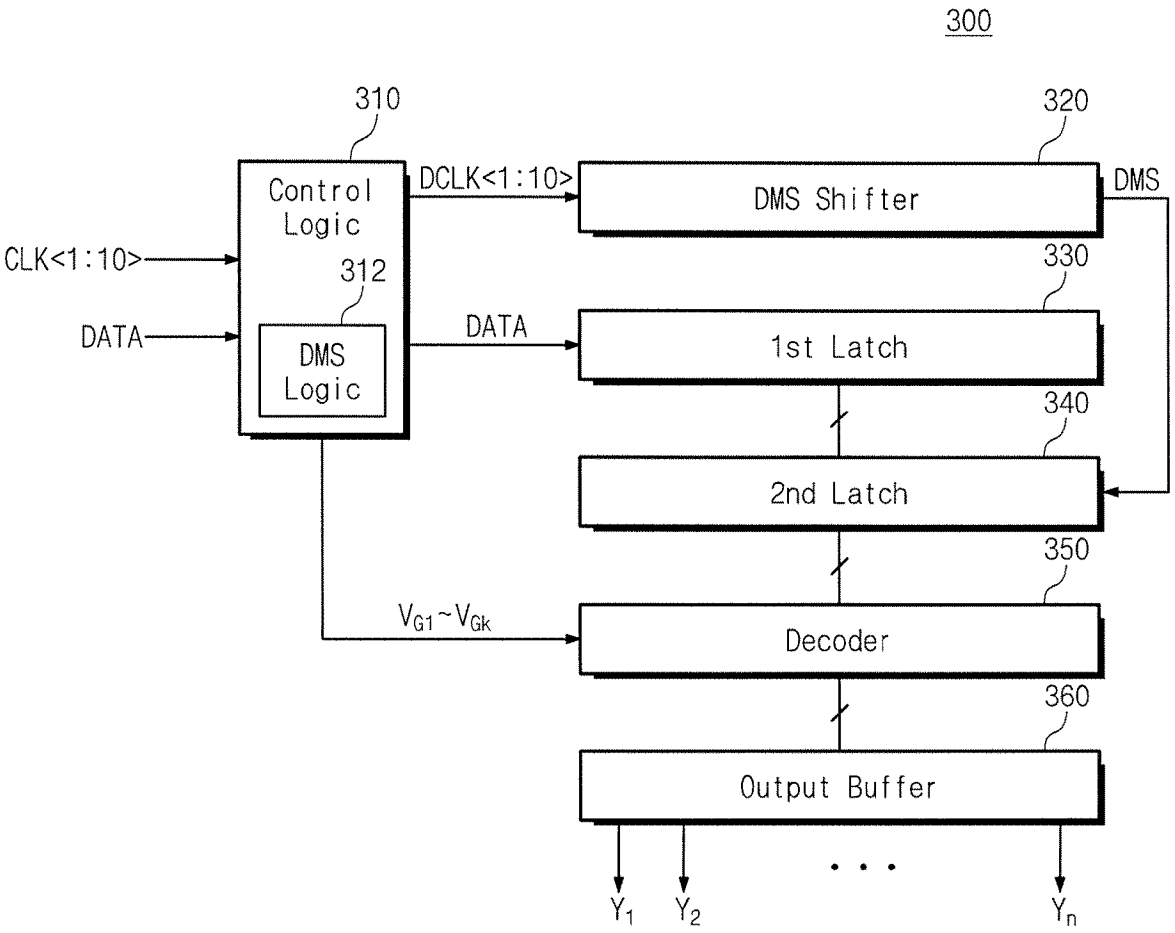
FIG. 2 is a block diagram schematically illustrating a source driver according to an exemplary embodiment of the inventive concept.

FIG. 2 is a block diagram schematically illustrating a source driver according to an exemplary embodiment of the inventive concept. Referring to FIG. 2, a source driver 300 contains control logic 310, a digital multi-spread (DMS) shifter 320, a first latch 330, a second latch 340, a decoder 350, and an output buffer 360. In an exemplary embodiment, at least one of the latches 330 and 340 is a flip-flop.

The control logic 310 is supplied with clocks CLK1 through CLK10 from a receiver (not shown) of the source driver 300. The receiver may generate the clocks CLK1 through CLK10, based on a clock CLK from a timing controller 100 (refer to FIG. 1). The clocks CLK1 through CLK10 have the same frequency and are delayed for as long as a reference period. For example, a phase locked loop (PLL) may be used to generate the clocks CLK1 through CLK10. An embodiment of the inventive concept is exemplified as ten clocks CLK1 through CLK10. The clocks CLK1 through CLK10 may be delayed as long as one-tenth times a period. Below, a value obtained by dividing a period of clocks, which the receiver (not shown) generates, by the number of clocks is referred to as "1 UI (unit interval)". In an exemplary embodiment, a 1UI value is a value obtained by dividing one period of clocks CLK1 through CLK10 by the number of clocks (e.g., 10). For example, each subsequent clock among the clocks CLK1 through CKL10 is delayed relative to the prior clock among the clocks. While use of ten clocks is described throughout, embodiments of the invention are not limited thereto as the control logic 310 may be supplied with less than or greater than ten clocks.

The control logic 310 converts input data DATA into parallel data. The control logic 310 outputs the parallel data to the first latch 330. The control logic 310 generates gamma reference voltages $V_{G1}$ through $V_{Gk}$ that are used to convert the parallel data into a data voltage, that is, a gray scale voltage. The control logic 310 outputs the gamma reference voltages $V_{G1}$ through $V_{Gk}$ to the decoder 350.

The control logic 310 contains DMS logic 312. The DMS logic 312 processes the input clocks CLK1 through CLK10 in various manners. For example, the DMS logic 312 enables 1UI-delayed clocks CLK1 through CLK10 to be delayed by 2UI and 3UI. Alternatively, the DMS logic 312 changes an output order of the delayed clocks CLK1 through CLK10 from CLK1 to CLK10 or from CLK10 to CLK1. The DMS logic 312 outputs the changed clocks DCLK1 through DCLK10 to the DMS shifter 320. The DMS logic 312 may be embodied by various combinations of different logic circuits (e.g., an AND gate, an inverter, an OR gate, etc.). An embodiment of the inventive concept is exemplified as the clocks DCLK1 through DCLK10 being delayed by 1UI from each other.

The DMS logic 312 changes a direction in which scanning of parallel data is performed on a display panel 400 through the source driver 300. For example, data may be scanned in one of the following manners: a right-shift manner in which data scanning is performed from a left end to a right end in a row of the display panel 400, a left-shift manner in which data scanning is performed from a right end to a left end in a row of the display panel 400, and a dual-shift manner in which data scanning is performed from a center to left and right ends in a row of the display panel 400. For example, in the right-shift manner, data is applied sequentially to the source lines in an order beginning from the left most source line and ending at the right most source line. For example, in the left-shift manner, data is applied sequentially to the source lines in an order beginning from the right most source line and ending at the left most source line. For example, in the dual-shift manner, data is applied sequentially to the source lines in an order beginning from a center most source line and continues to the left most source line, and begins again at a source line to the right of the center most source line and continues to the right most source line. The DMS logic 312 selects one of the data scanning manners as an operating mode of a display device randomly or as needed.

The DMS shifter 320 generates DMS signals for adjusting timing when data stored at the second latch 340 is output to the display panel 400 through the first latch 330. The DMS shifter 320 operates on a group of delayed clocks to generate right shifted signals, left shifted signals, or a combination of right and left shifted signals. For example, during a given period of time, the delayed clocks have multiple pulses, and during the same given period, the shifted signals only include a single one of those pulses. In an exemplary embodiment of the inventive concept, a carry signal is not used to generate the DMS signals, and the DMS signals are instead generated from one clock CLK. A device and method for generating DMS signals will be more fully described with reference to FIG. 4.

The first latch 330 temporarily stores parallel data received from the control logic 310. The parallel data may be sequentially stored at the first latch 330 to correspond to a position where it is output to the display panel 400.

The second latch 340 receives the parallel data from the first latch 330. The second latch 340 outputs the parallel data to the decoder 350 at a required time in response to the DMS signal from the DMS shifter 320.

The decoder 350 converts the parallel data stored in the second latch 340 into a data voltage, that is, a gray scale voltage, based on the gamma reference voltages $V_{G1}$ through $V_{Gk}$ from the control logic 310.

The output buffer 360 may include a plurality of buffers (not shown). The output buffers receive the data voltage from the decoder 350 and output image data to the display panel 400. Red, green, and blue data may be sequentially output through channels $Y_1$ through $Y_n$ connected to the output buffer 360. However, this order may be changed.

Figure 3:
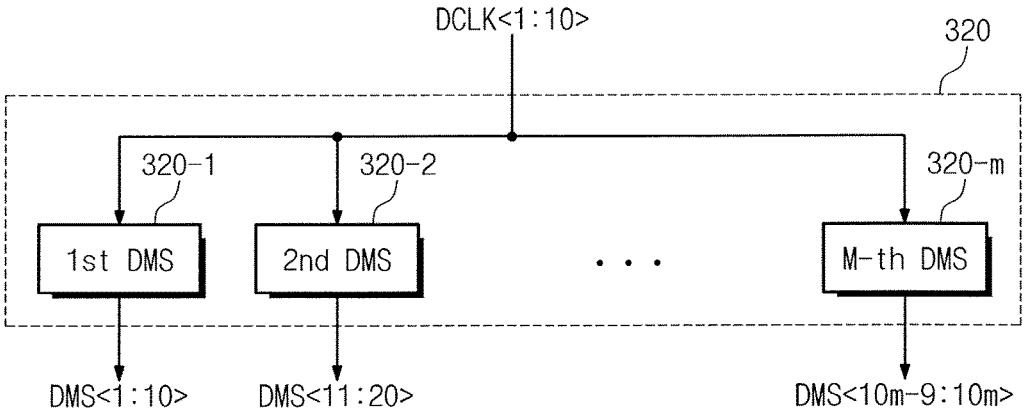
FIG. 3 is a diagram showing a DMS shifter shown in FIG. 2 in detail.

FIG. 3 is a diagram showing a DMS shifter 320 shown in FIG. 2 in detail. Referring to FIG. 3, a DMS shifter 320 contains a plurality of DMS blocks 320-1 through **320-*m* (e.g., main circuits). Structures of the DMS blocks 320-1 through 320-*m*** may be similar to each other or substantially the same.

Each of the DMS blocks 320-1 through **320-*m* receives DCLK1 through DCLK10 to generate DMS signals. For example, one DMS block may generate ten DMS signals. A plurality of DMS signals DMS1 through DMS10*m* may be delayed by as much as a reference period (e.g., 1UI) from one another. The DMS signals DMS1 through DMS10*m* are used to adjust output timing of data signals output through channels $Y_1$ through $Y_n$ of an output buffer 360 (refer to FIG. 2). Thus, the number of DMS signals is equal to the number of channels (i.e., 10*m*** is equal to n).

In an exemplary embodiment of the inventive concept, a carry signal is not used to generate a DMS signal for adjusting output timing of image data. A plurality of DMS clocks are generated using a plurality of DCLKs that are generated using one clock CLK.

Since output timing of image data is adjusted using DMS clocks without use of a carry signal, the time taken to charge pixels may be reduced and the output timing of image data may be changed more easily.

Figure 4:
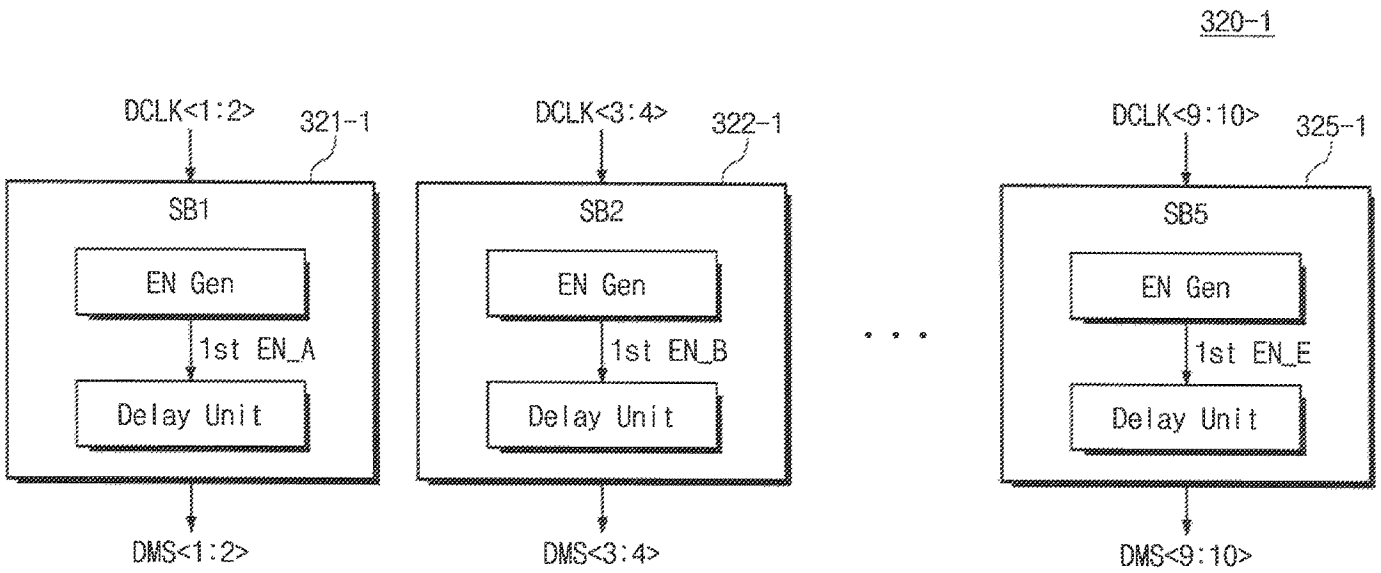
FIG. 4 is a block diagram schematically illustrating a first DMS block shown in FIG. 3.

FIG. 4 is a block diagram schematically illustrating a first DMS block (e.g., a first main circuit) shown in FIG. 3. Structures of first through M-th DMS blocks 320-1 through **320-*m* are similar to each other or substantially the same as each other. The first DMS block 320-1 according to an embodiment of the inventive concept is exemplified in FIG. 4**.

The first DMS block 320-1 includes a plurality of sub blocks 321-1 through 325-1 (e.g., sub circuits). Each of the sub blocks 321-1 through 325-1 contains an enable signal generator and a delay unit.

Each of the sub blocks 321-1 through 325-1 receives two of the DCLK signals. For example, if there are 10 DCLK signals, five sub blocks are present where each sub block receives a next two DCLK signals among the 10 DCLK signals. The sub blocks 321-1 through 325-1 internally generate enable signals 1st EN_A through 1st EN_E using the corresponding two DCLK signals, respectively. The sub blocks 321-1 through 325-1 delay and output corresponding DCLK signals in response to corresponding enable signals 1st EN_A through 1st EN_E. In an exemplary embodiment, the DCLK signals DCLK1 through DCLK10 and the DMS signals DMS1 through DMS10 are sequentially delayed for as long as a reference period (e.g., 1UI).

In an exemplary embodiment of the inventive concept, the sub blocks 321-1 through 325-1 generate DMS signals for changing output timing of an image signal using the DCLK signals, thereby preventing a signal delay between DMS blocks for using a carry signal.

Figure 5A:
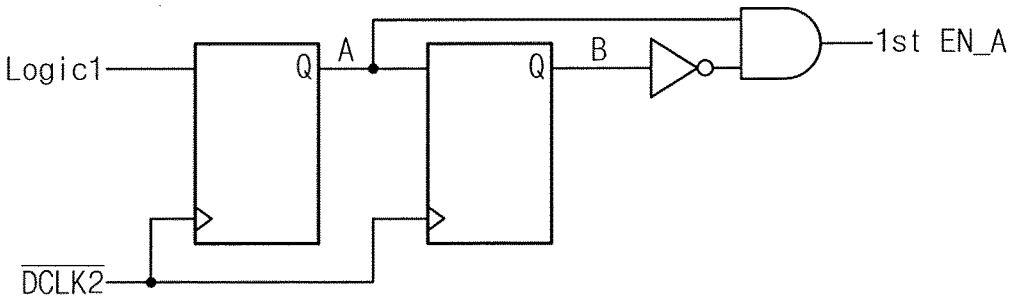
FIG. 5A is a diagram schematically illustrating an enable signal generator shown in FIG. 4 according to an exemplary embodiment of the inventive concept.

FIG. 5A is a diagram schematically illustrating an enable signal generator shown in FIG. 4 according to an exemplary embodiment of the inventive concept. Enable signals 1st EN_A through 1st EN_E may be used to generate DMS signals using DCLK signals. For example, a DMS signal is generated by performing an AND operation on an enable signal and a DCLK signal. In an embodiment, the AND operation for generating a DMS signal may be performed using an AND gate (not illustrated). Enable signals that a first DMS block generates are marked by "1 st EN_A" through "1st EN_E", respectively. Likewise, enable signals that a second DMS block generates are marked by "2nd EN_A" through "2nd EN_E", respectively. How an enable signal generator of a first sub block 321-1 generates a first enable signal 1st EN_A will be more fully described with reference to FIG. 5A.

In an exemplary embodiment, the enable signal generator (e.g., EN Gen) generates the first enable signal 1st EN_A using two flip-flops, an inverter, and an AND gate. In an exemplary embodiment, the flip-flops are implemented with a positive edge trigger type of flip-flop. That is, the flip-flops may output logic "1" during a rising period of a DCLK2 bar signal. In an exemplary embodiment, an additional inverter is present to invert the DCLK2 signal so it can be applied to a clock terminal of the positive edge trigger type flip flop. However, the inventive concept is not limited thereto. For example, the flip-flops may be implemented with a negative edge trigger type of flip-flop. The DCLK2 signal may be applied to the clock terminal of the negative edge trigger type of flip flop. A waveform of the enable signal 1st EN_A is illustrated in FIG. 5C.

As described above, an enable signal is generated using DCLK2. An AND operation is performed on DCLK1 as well as DCLK2 to generate more accurate DMS1 and DMS2 signals. Upon performing an AND operation on DCLK1 and an enable signal generated using DCLK1, a tail portion of the DMS1 signal being output is removed by as much as 1UI. This means a reduction in timing when data is output. In other words, a time taken to charge pixels is insufficient. In contrast, it is possible to generate an enable signal using DCLK1, but a component is required for delaying the generated enable signal by 1UI or more.

Figure 5B:
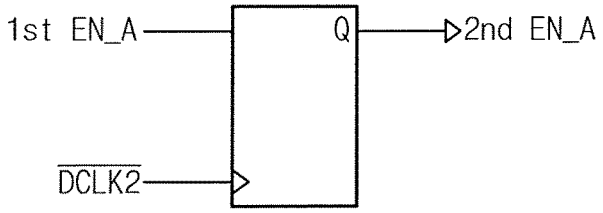
FIG. 5B is a diagram schematically illustrating a delay unit shown in FIG. 4 according to an exemplary embodiment of the inventive concept.
Figure 5C:
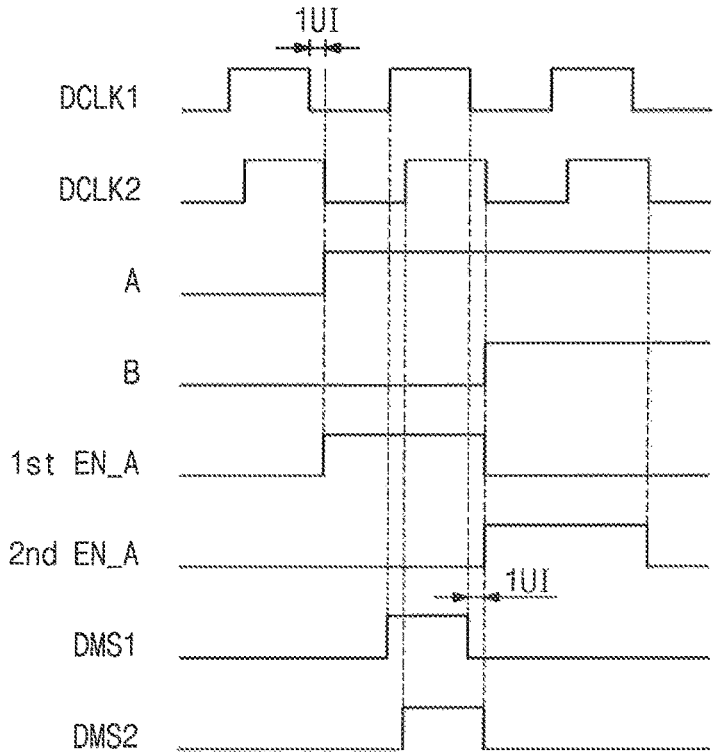
FIG. 5C is a diagram showing output waveforms of an enable signal generator and a delay unit.
Figure 5D:
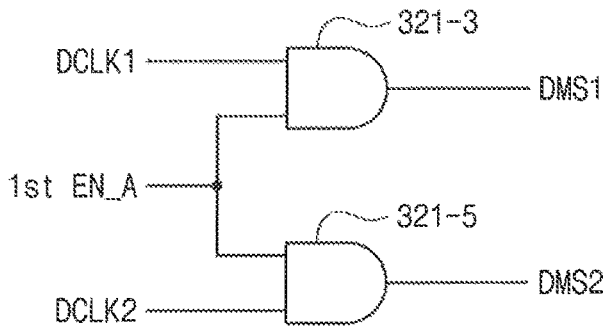
FIG. 5D illustrates exemplary circuitry that could be used to generate DMS signals of the output waveforms.

FIG. 5B is a diagram schematically illustrating a delay unit shown in FIG. 4 according to an exemplary embodiment of the inventive concept. A delay unit may enable DMS signals to be delayed among DMS blocks 320-1 through **320-*m* (refer to FIG. 3). Since sub blocks 321-1 through 325-1 (refer to FIG. 4) generate enable signals using different DCLK signals (e.g., each using a different pair of DCLK signals), enable signals that one DMS block generates may be delayed by as much as 2UI. However, since each of DMS blocks 320-1 through 320-*m* generates an enable signal using the same DCLK signals DCLK1 through DCLK10**, it is necessary to delay and output enable signals that each DMS block generates.

Since the delay unit is implemented as illustrated in FIG. 5B, it is possible to delay enable signals among DMS blocks. Accordingly, a flip-flop may be implemented with, but is not limited to, a negative edge trigger type of flip-flop. For example, the flip-flop may be implemented with a positive edge trigger type of flip-flop. FIG. 5C shows waveforms of an enable signal 1st EN_A, which a first sub block of a first DMS block generates, and an enable signal 2nd EN_A which a first sub block of a second DMS block generates. In an m-th DMS block, a delay unit may be implemented by connecting (m−1) flip-flops. In conclusion, delay units included in the first DMS block (referring FIG. 3, 320-1) do not delay enable signals (referring FIG. 4, 1st EN_A through 1st EN_E). Alternatively, the first DMS block does not include delay units. And, delay units included in the second DMS block (referring FIG. 3, 320-2) may delay enable signals (1st EN_A through 1st EN_E) by one period to generate signals (2nd EN_A through 2ndt EN_E), as will be shown in FIG. 6A. Such delay operations may be performed with respect to the other DMS blocks.

Figure 6A:
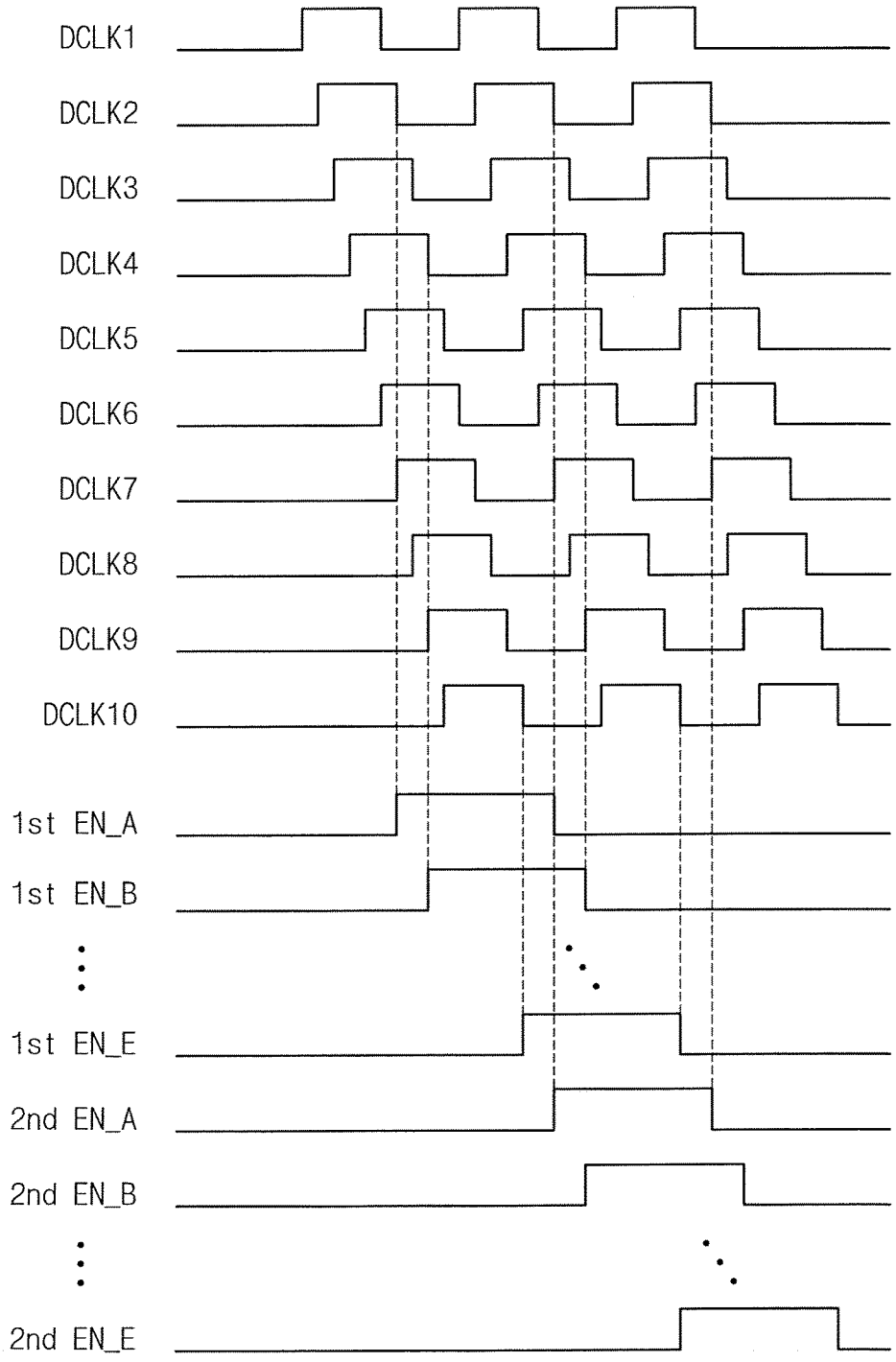
FIG. 6A is a diagram showing output waveforms of DCLK signals and enable signals generated using DCLK signals.
Figure 6B:
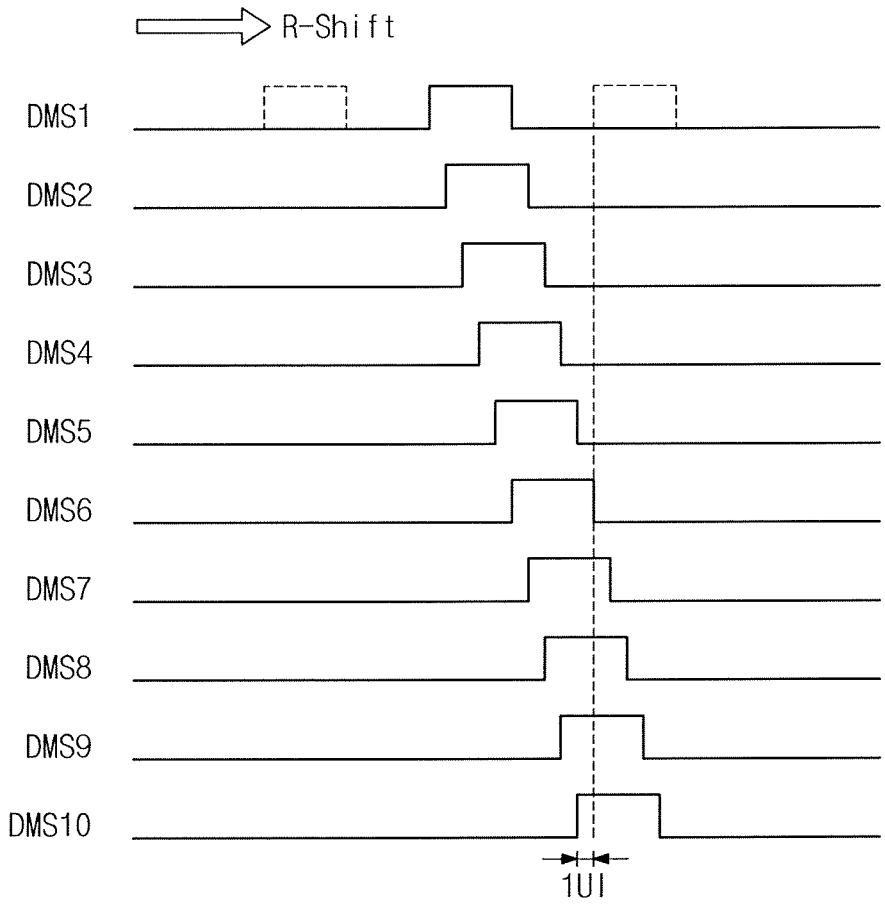
FIG. 6B is a diagram showing output waveforms of DMS signals generated using DCLK signals and enable signals.

FIG. 6A is a diagram showing output waveforms of DCLK signals and enable signals generated using DCLK signals. FIG. 6B is a diagram showing output waveforms of DMS signals generated using DCLK signals and enable signals.

Referring to FIGS. 6A and 6B, DCLK signals DCLK1 through DCLK10 are sequentially delayed by as long as a reference period (e.g., 1UI) from one another and then are provided to DMS blocks 320-1 through **320-*m* (refer to FIG. 3**).

A first sub block 321-1 (refer to FIG. 4) of a first DMS block 320-1 generates 1st EN_A using DCLK1 and DCLK2. DMS1 is produced through an AND operation performed on DCLK1 and 1st EN_A, and DMS2 is generated through an AND operation performed on DCLK2 and 1st EN_A.

A second sub block 322-1 (refer to FIG. 4) of the first DMS block generates 1st EN_B using DCLK3 and DCLK4. DMS3 is produced through an AND operation performed on DCLK3 and 1st EN_B, and DMS4 is generated through an AND operation performed on DCLK4 and 1st EN_B.

DMS5 through DMS10 for the remaining sub blocks of the first DMS block may be produced in a similar manner.

A first sub block of a second DMS block 320-2 generates 2nd EN_A using DCLK1 and DCLK2. DMS11 is produced through an AND operation performed on DCLK1 and 2nd EN_A, and DMS12 is generated through an AND operation performed on DCLK2 and 2nd EN_A.

A second sub block of the second DMS block 320-2 generates 2nd EN_B using DCLK3 and DCLK4. DMS13 is produced through an AND operation performed on DCLK3 and 2nd EN_B, and DMS14 is generated through an AND operation performed on DCLK4 and 2nd EN_B.

DMS15 through DMS20 for the remaining sub blocks of the second DMS block generate may be produced in a similar manner. In addition, DMS31 through DMS**10*m*** for sub blocks of third through M-th DMS blocks may be produced in a similar manner.

Each sub block of the DMS blocks 320-1 through **320-*m* includes an enable signal generator (e.g., EN Gen) to generate an enable signal and a delay unit, and a DMS shifter 320 (refer to FIG. 2**) sequentially outputs sequentially delayed DMS signals. In an exemplary embodiment of the inventive concept, no carry signal is used to generate DMS signals for controlling output timing of image data. DCLK signals are generated using a clock provided to a timing controller, and DMS signals are produced using the DCLK signals. Since a carry signal is not used, the time taken to charge pixels may be reduced and the output timing of image data may be changed more easily.

Figure 7:
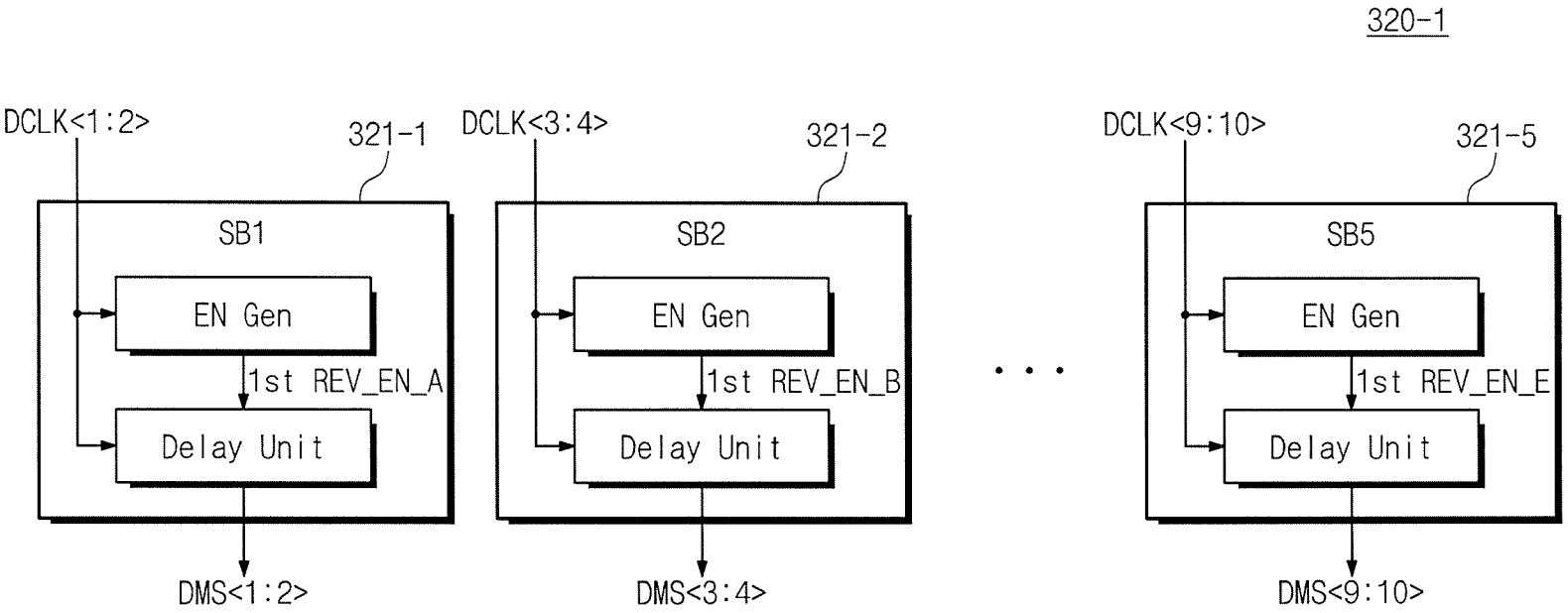
FIG. 7 is a block diagram schematically illustrating a first DMS block according to an exemplary embodiment of the inventive concept.

FIG. 7 is a block diagram schematically illustrating a first DMS block according to an exemplary embodiment of the inventive concept.

The fundamental configuration and function of a first DMS block 320-1 is similar to that shown in FIG. 4, and a duplicated description is thus omitted. A left-shift manner where scanning about image data is made from right to left in a row of a display panel will be described with reference to FIG. 7.

Referring to FIG. 7, DCLK signals DCLK1 through DCLK10 are sequentially supplied to a first DMS block 320-1. In this embodiment, delay is sequentially made from DCLK10 to DCLK1. DCLK10 supplied to a sub block 321-5 may be delayed by as long as a reference period (e.g., 1UI) as compared with DCLK11 supplied to a first sub block of a second DMS block 320-2 (refer to FIG. 2). That is, DCLK signals may be supplied sequentially from a fifth sub block of an M-th DMS block **320-*m* (refer to FIG. 3) to a first sub block of the first DMS block 320-1 (refer to FIG. 3**). Delay between DCLK signals may correspond to "1UI".

Reverse enable signals that sub blocks generate may be sequentially delayed in order from a reverse enable signal M-th REV_EN_E, which a fifth sub block of an M-th DMS block generates, to a reverse enable signal 1st REV_EN_A which a first sub block of a first DMS block generates. Because one reverse enable signal is generated using two DCLK signals, delay among reverse enable signals may correspond to "2UI".

Figure 8A:
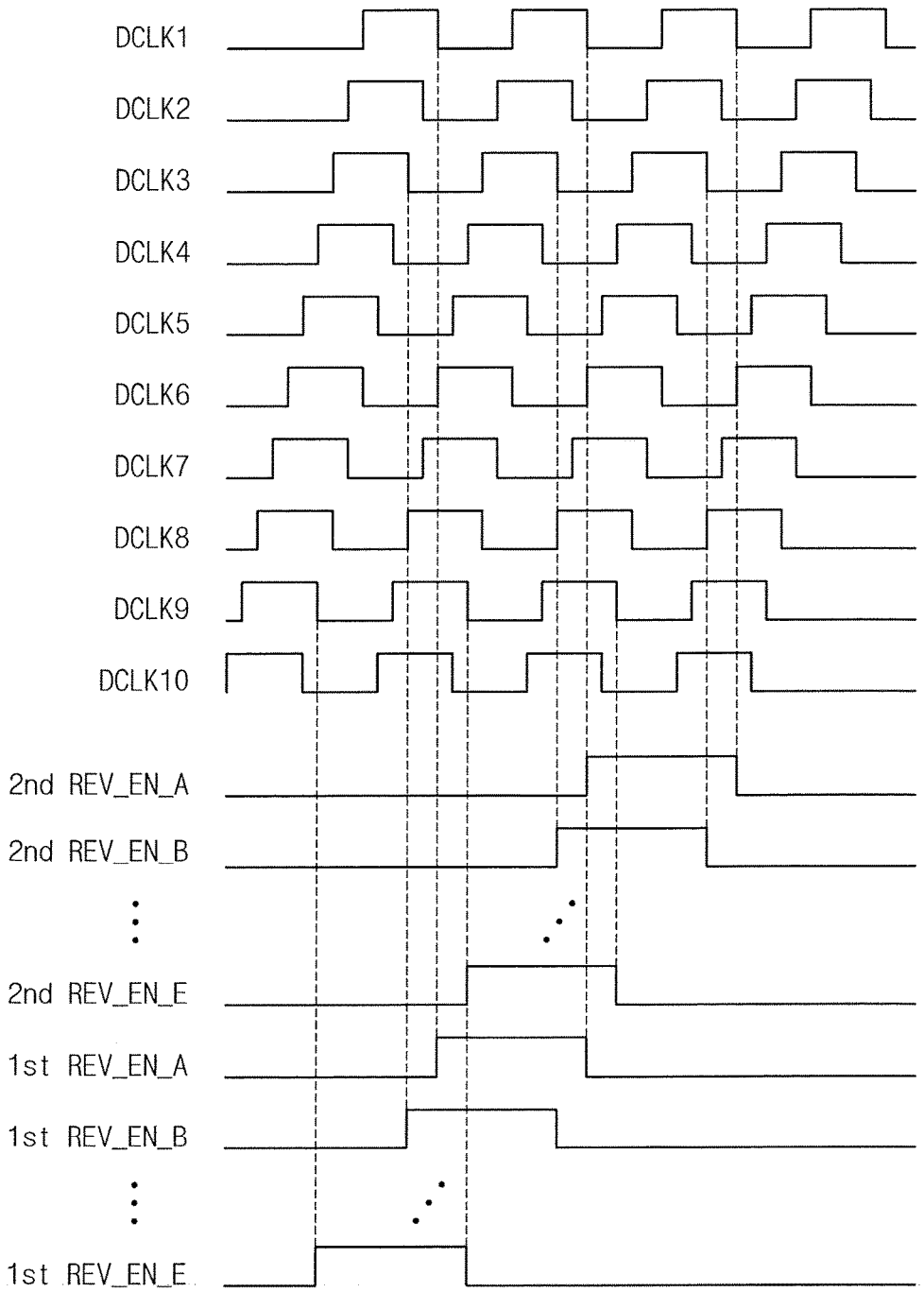
FIG. 8A is a diagram showing output waveforms of DCLK signals and reverse enable signals generated using DCLK signals.
Figure 8B:
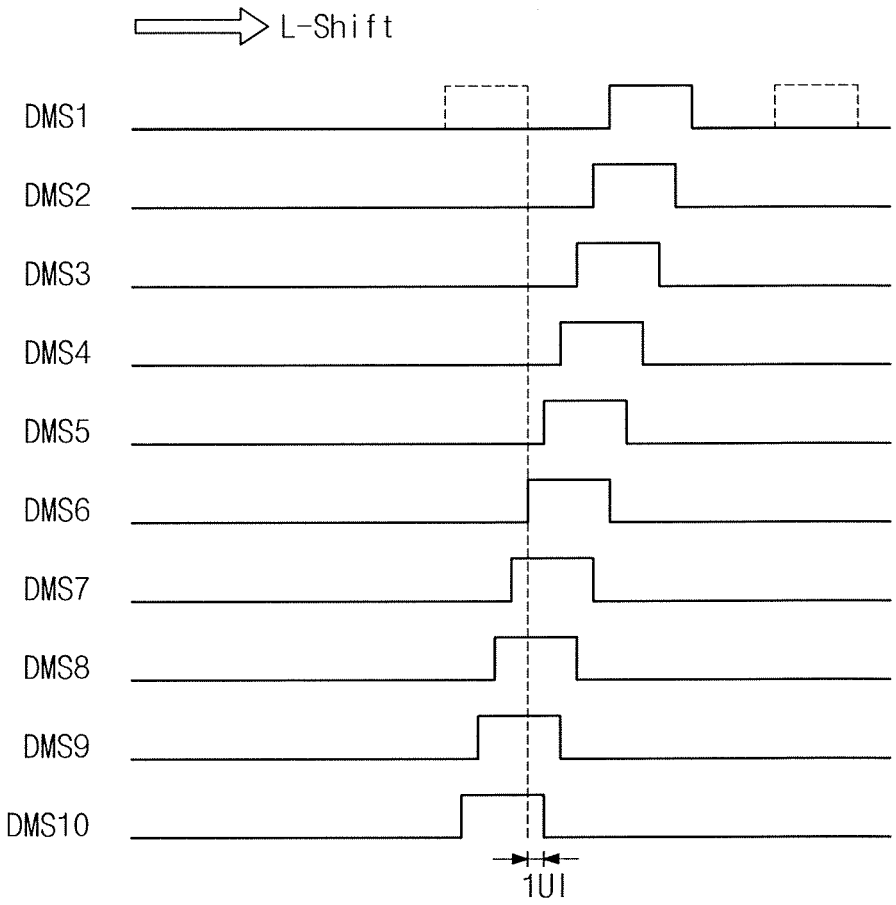
FIG. 8B is a diagram showing output waveforms of DMS signals generated using DCLK signals and reverse enable signals.

FIG. 8A is a diagram showing output waveforms of DCLK signals and reverse enable signals generated using DCLK signals. FIG. 8B is a diagram showing output waveforms of DMS signals generated using DCLK signals and reverse enable signals.

A left-shift manner shown in FIGS. 8A and 8B is substantially the same as a right-shift manner except for an input order of DCLK signals, an output order of reverse enable signals, and an output order of DMS signals, and a duplicated description is thus omitted.

Figure 9:
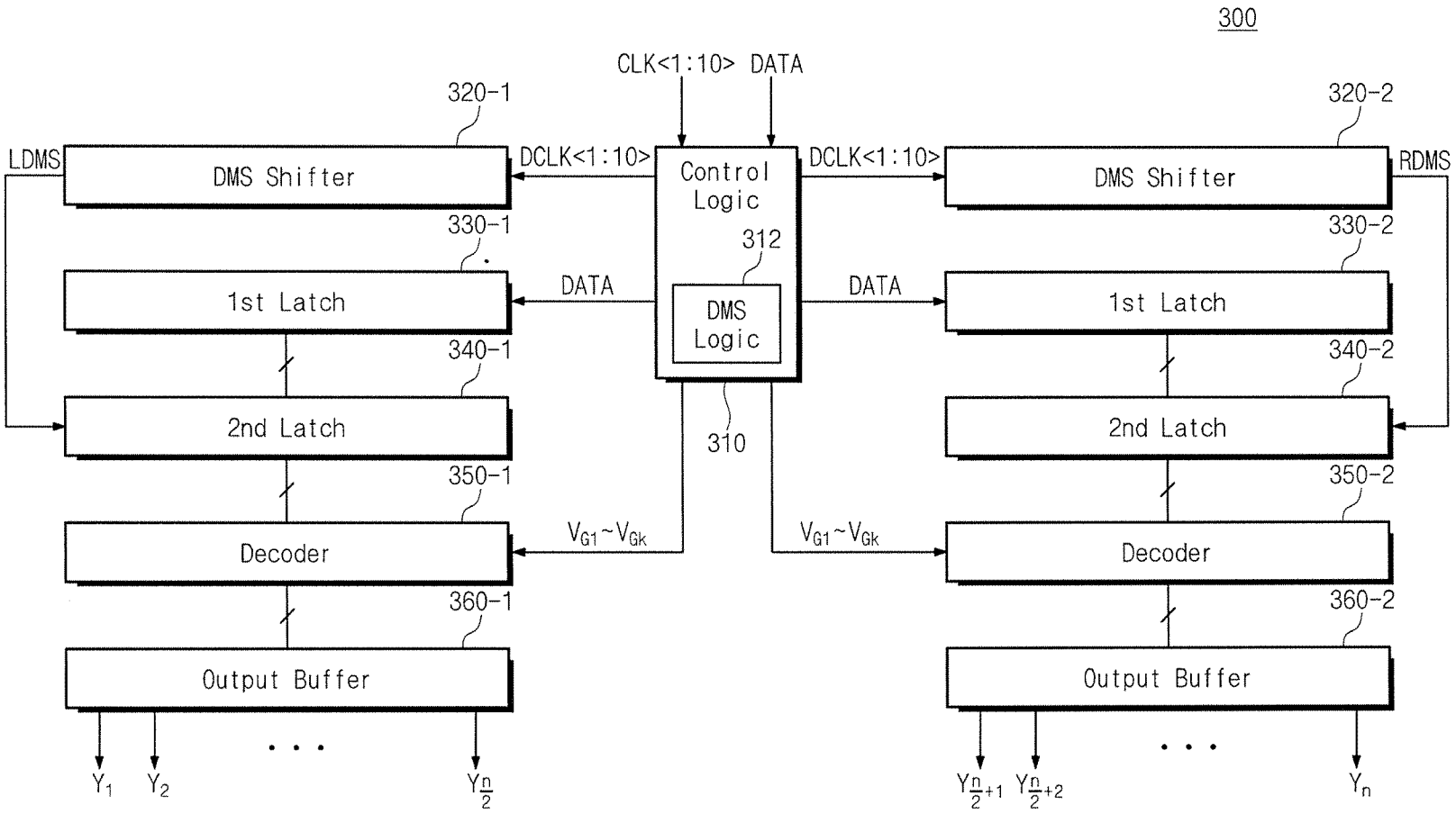
FIG. 9 is a block diagram schematically illustrating a source driver according to an exemplary embodiment of the inventive concept.

FIG. 9 is a block diagram schematically illustrating a source driver according to an exemplary embodiment of the inventive concept. A dual-shift manner V-shift where scanning of image data is simultaneously performed from left and right ends of a display panel to a center thereof will be more fully described with reference to FIG. 9.

Referring to FIG. 9, a source driver 300 includes control logic 310, digital multi-spread (DMS) shifters 320-1 and 320-2, first latches 330-1 and 330-2, second latches 340-1 and 340-2, decoders 350-1 and 350-2, and output buffers 360-1 and 360-2. Configurations and functions of the components shown in FIG. 9 are similar to those described above, and a duplicated description is thus omitted.

The DMS shifter 320-1, first latch 330-1, second latch 340-1, decoder 350-1, and output buffer 360-1 may be used to enable scanning of image data to be performed from a left end of a display panel to a center thereof (R-shift). The image data may be supplied to the display panel through channels $Y_1$ through $Y_{n/2}$ connected to the output buffer 360-1 under a control of an LDMS signal that the DMS shifter 320-1 generates.

The DMS shifter 320-2, first latch 330-2, second latch 340-2, decoder 350-2, and output buffer 360-2 may be used to enable scanning of image data to be performed from a right end of the display panel to a center thereof (L-shift). The image data may be supplied to the display panel through channels $Y_{(n/2)+1}$ through $Y_n$ connected to the output buffer 360-2 under a control of an RDMS signal that the DMS shifter 320-2 generates.

Figure 10:
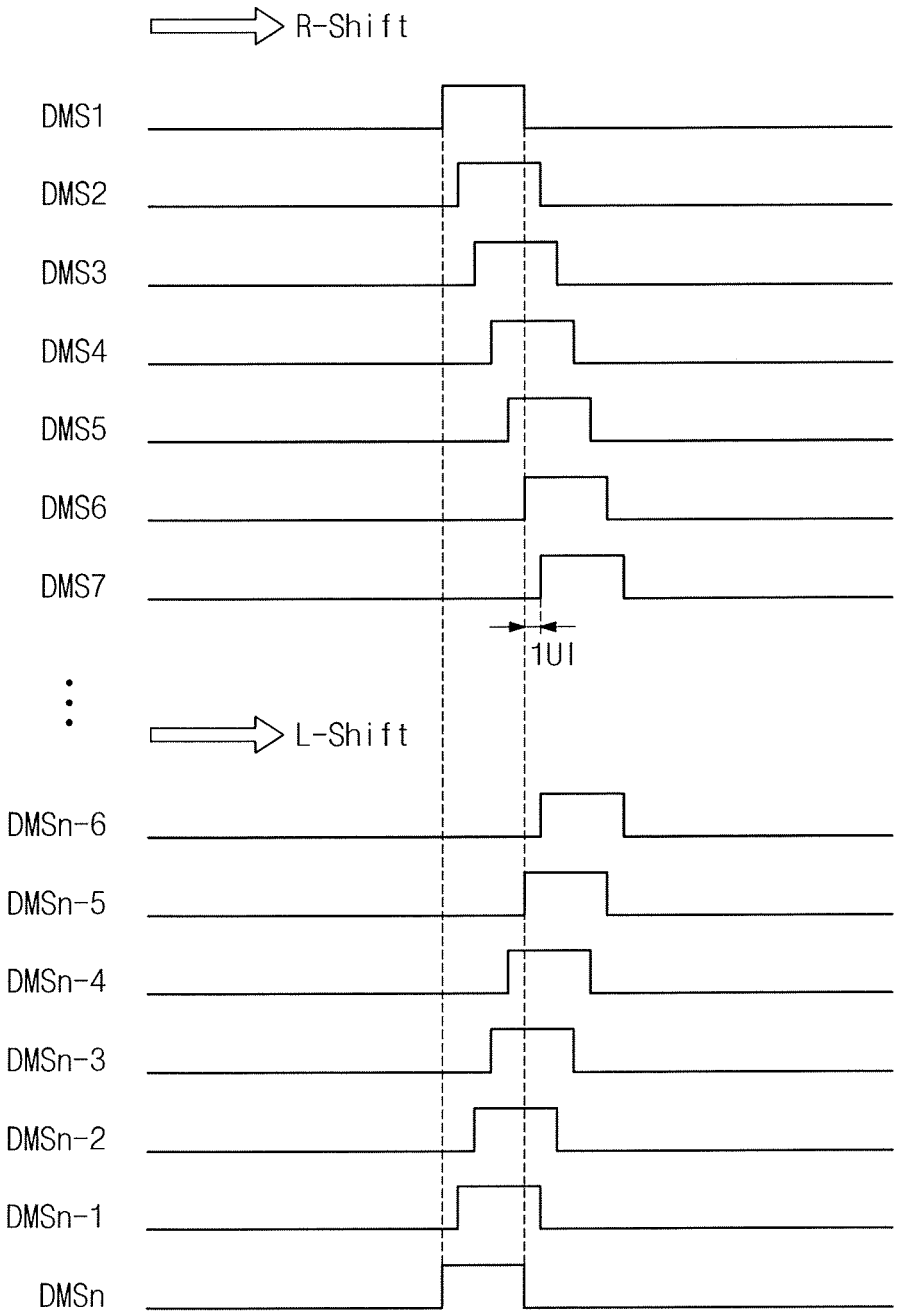
FIG. 10 is a diagram showing output waveforms of DMS signals generated according to an embodiment shown in FIG. 9.

FIG. 10 is a diagram showing output waveforms of DMS signals generated according to an embodiment shown in FIG. 9.

DMS signals DMS1 through DMSn/2 are sequentially output through channels $Y_1$ through $Y_{n/2}$ connected to an output buffer 360-1 (refer to FIG. 9) (R-shift). DMS signals DMSn through DMS(n/2)+1 are sequentially output through channels $Y_{(n/2)+1}$ through $Y_n$ connected to the output buffer 360-2 (refer to FIG. 9) (L-shift).

In an exemplary embodiment of the inventive concept, no carry signal is used to generate DMS signals for controlling output timing of image data. DCLK signals are generated using a clock provided to a receiver (not shown) of a source driver, and LDMS signals and RDMS signals are produced using the DCLK signals. Thus, since a carry signal is not used, the time taken to charge pixels may be reduced and the output timing of image data may be changed more easily.

When scanning of image data is performed in the dual-shift manner (V-shift) as illustrated in FIG. 10, image data is displayed more efficiently. The reason is to reduce a time taken to charge pixels as an operating frequency, a scanning rate, or the size of display panel increases.

Figure 11:
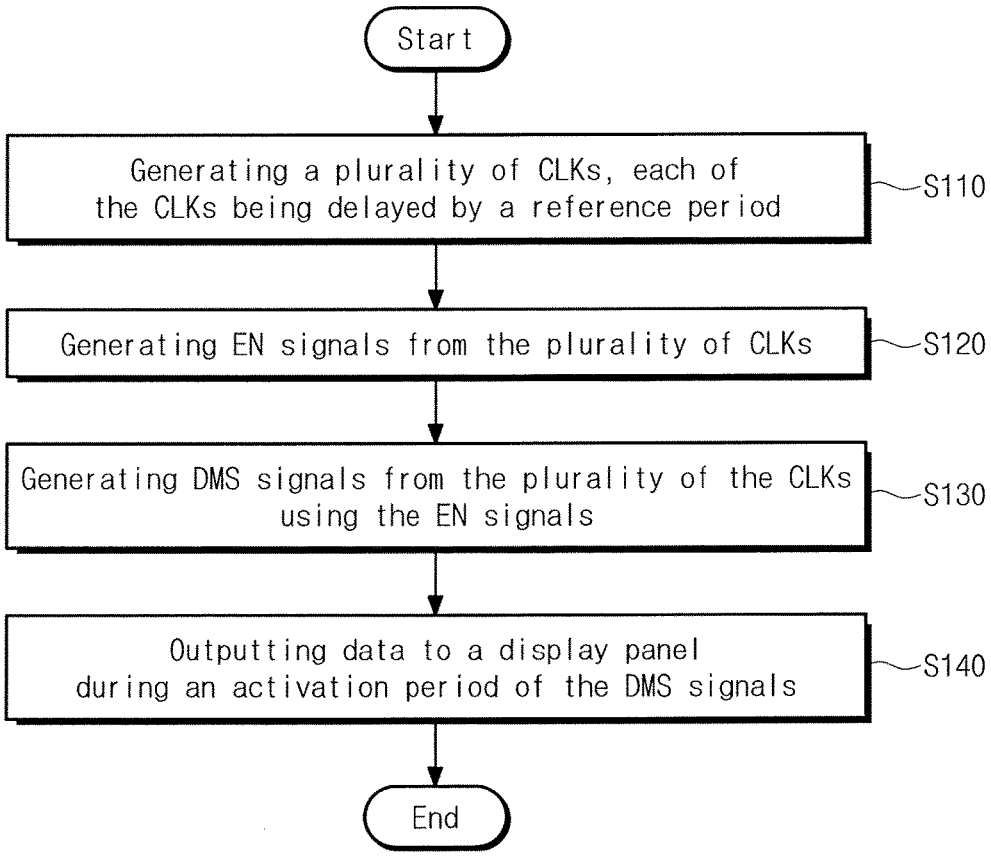
FIG. 11 is a flowchart showing a data output method of a display device according to an exemplary embodiment of the inventive concept.

FIG. 11 is a flowchart showing a data output method of a display device according to an exemplary embodiment of the inventive concept.

The method includes generating clocks using a clock received from an external device (S110). A delay between the clocks may correspond to a reference period. For example, a receiver of a source driver may include a phase locked loop (PLL) that generates a plurality of clocks based on the external clock.

The method includes generating enable signals based on the generated clocks (S120). The enable signals are used to generate DMS signals for controlling output timing of a data signal to be transmitted to a display panel. The enable signals may be selectively generated based on an operating mode of the display device, such as left-shift, right-shift, or dual-shift. The enable signals are constantly generated based on the clocks generated in step S110 without a carry signal.

The method includes generating DMS signals that are based on the clocks generated in step S110 using the enable signals (S130). Likewise, the DMS signals may be selectively generated based on an operating mode of the display device, such as left-shift, right-shift, or dual-shift.

The method includes outputting image data to the display panel during a period where the DMS signals are activated (S140).

In embodiments of a device and method capable of generating DMS signals as described above, the time taken to charge pixels may be reduced, thereby making it possible to more precisely control timing when image data is output. Accordingly, the performance of the display device may be improved.

While the inventive concept has been described with reference to exemplary embodiments thereof, it will be apparent to those skilled in the art that various changes and modifications may be made without departing from the spirit and scope of the inventive concept. Therefore, it should be understood that the above embodiments are not limiting, but illustrative.

What is claimed is:

1. A source driver circuit, comprising:

a digital multi-spread (DMS) shifter configured to:

receive a first clock signal and a second clock signal, wherein the second clock signal is delayed by a reference period compared to the first clock signal;

generate a first enable signal which is enabled during an entire period between first edges of two adjacent pulses from among the second clock signal;

generate a first DMS signal based on the first clock signal and the first enable signal; and generate a second DMS signal based on the second clock signal and the first enable signal, wherein the first DMS signal is generated by a first logical AND operation performed on the first clock signal and the first enable signal, wherein the second DMS signal is generated by a second logical AND operation performed on the second clock signal and the first enable signal, and wherein the first edges are of a same type.

2. The source driver circuit of claim 1, wherein the DMS shifter is further configured to:

receive a third clock signal and a fourth clock signal, wherein the third clock signal is delayed by the reference period compared to the second clock signal, and the fourth clock signal is delayed by the reference period compared to the third clock signal;

generate a second enable signal which is enabled between first edges of two adjacent pulses from among the fourth clock signal;

generate a third DMS signal based on the third clock signal and the second enable signal; and generate a fourth DMS signal based on the fourth clock signal and the second enable signal.

3. The source driver circuit of claim 1, further comprising:

a control logic configured to generate the first clock signal and the second clock signal based on a same clock signal.

4. The source driver circuit of claim 1, wherein the first edges are falling edges of the two adjacent pulses from among the second clock signal.

5. The source driver circuit of claim 1, further comprising:

a first latch configured to receive image data; and a second latch configured to receive the image data from the first latch and the first DMS signal and the second DMS signal from the DMS shifter, and output the image data in response to the first DMS signal and the second DMS signal.

6. The source driver circuit of claim 1, wherein the DMS shifter includes:

a first DMS block configured to generate the first DMS signal and the second DMS signal; and a second DMS block configured to:

receive a third clock signal and a fourth clock signal, wherein the third clock signal is delayed by a one period of the third clock signal compared to the second clock signal, and the fourth clock signal is delayed by the reference period compared to the third clock signal;

generate a second enable signal which is enabled between first edges of two adjacent pulses from among the fourth clock signal;

generate a third DMS signal based on the third clock signal and the second enable signal; and generate a fourth DMS signal based on the fourth clock signal and the second enable signal.

7. The source driver circuit of claim 6, wherein the second DMS block is further configured to delay the second enable signal by a one period of the first enable signal compared to the first enable signal.

8. The source driver circuit of claim 6, wherein the first DMS block includes a first enable signal generator configured to generate the first enable signal, and wherein the second DMS block includes:

a second enable signal generator configured to generate the second enable signal; and a delay unit configured to delay the second enable signal by a one period of the first enable signal compared to the first enable signal.

9. A method of operating a source driver circuit, the method comprising:

receiving a first clock signal and a second clock signal, wherein the second clock signal is delayed by a reference period compared to the first clock signal;

generating a first enable signal which is enabled during an entire period between first edges of two adjacent pulses from among the second clock signal;

generating a first digital multi-spread (DMS) signal based on the first clock signal and the first enable signal; and generating a second DMS signal based on the second clock signal and the first enable signal, wherein generating the first DMS signal includes performing a first logical AND operation on the first clock signal and the first enable signal, and wherein generating the second DMS signal includes performing a second logical AND operation on the second clock signal and the first enable signal, and wherein the first edges are of a same type.

10. The method of claim 9, further comprising:

receiving a third clock signal and a fourth clock signal;

generating a second enable signal which is enabled between first edges of two adjacent pulses from among the fourth clock signal;

generating a third DMS signal based on the third clock signal and the second enable signal; and generating a fourth DMS signal based on the fourth clock signal and the second enable signal, wherein the third clock signal is delayed by a one period of the third clock signal compared to the second clock signal, and the fourth clock signal is delayed by the reference period compared to the third clock signal.

11. The method of claim 9, further comprising: generating the first clock signal and the second clock signal based on a same clock signal.

12. The method of claim 9, wherein the first DMS signal and the second DMS signal are used for controlling an output timing of a data signal to be transmitted to a display panel.

13. A source driver circuit, comprising:

a digital multi-spread (DMS) shifter configured to:

receive a first clock signal and a second clock signal, wherein the second clock signal is delayed by a reference period compared to the first clock signal;

generate a first enable signal which is enabled during an entire period between first edges of two adjacent pulses from among the second clock signal;

generate a first DMS signal based on the first clock signal and the first enable signal; and generate a second DMS signal based on the second clock signal and the first enable signal, wherein the first edges are of a same type, wherein the source driver includes a plurality of main circuits configured to generate a plurality of DMS signals which includes the first DMS signal and the second DMS signal for controlling an output timing of a data signal to be transmitted to a display panel, each main circuit including a plurality of sub circuits, wherein each sub circuit includes:

an enable signal generator configured to generate the first enable signal for outputting a subset of the DMS signals using a pair of adjacent clock signals selected from the plurality of clock signals, wherein each sub circuit receives a different pair of adjacent clock signals; and a delay unit configured to delay the subset of DMS signals such that the subset of DMS signals are sequentially delayed by the reference period based on the latter of the pair of adjacent clock signals.

* * * * *